US011220871B2

(12) United States Patent
Eckmann

(10) Patent No.: US 11,220,871 B2
(45) Date of Patent: Jan. 11, 2022

(54) METHODS FOR CLEANING DRILL PIPE DURING TRIP-OUT

(71) Applicant: Ronald Thorsten Eckmann, College Station, TX (US)

(72) Inventor: Ronald Thorsten Eckmann, College Station, TX (US)

( * ) Notice: Subject to any disclaimer, the term of this patent is extended or adjusted under 35 U.S.C. 154(b) by 65 days.

(21) Appl. No.: 16/679,825

(22) Filed: Nov. 11, 2019

(65) Prior Publication Data

US 2021/0140249 A1 May 13, 2021

(51) Int. Cl.
*E21B 19/00* (2006.01)
*E21B 47/06* (2012.01)

(52) U.S. Cl.
CPC ..... *E21B 19/00* (2013.01); *E21B 47/06* (2013.01)

(58) Field of Classification Search
CPC ..... E21B 19/00; E21B 19/16; E21B 19/165; E21B 21/01; E21B 47/06; E21B 21/08
See application file for complete search history.

(56) References Cited

U.S. PATENT DOCUMENTS 3,963,077 A * 6/1976 Faulkner ..... E21B 21/08 166/377
4,351,400 A * 9/1982 Faulkner ..... E21B 21/14 175/69
4,394,800 A * 7/1983 Griset ..... B23B 47/287 33/32.3
4,406,331 A 9/1983 Bentley
4,577,700 A * 3/1986 Dellinger ..... E21B 19/16 175/40
4,577,702 A * 3/1986 Faulkner ..... E21B 34/063 166/317
5,170,853 A 12/1992 Mason et al.
5,842,252 A 12/1998 Cameron et al.
7,086,481 B2 8/2006 Hosie et al.
7,621,344 B2 11/2009 Frey
9,587,439 B2 3/2017 Lamik-Thonhauser et al.
2002/0157838 A1 10/2002 Ayling
(Continued)

OTHER PUBLICATIONS

Petrolyte, "Slug Calculation in Barrels for a Length of Dry Pipe", 2017, Petrolyte: http://petrolyte.blogspot.com/2014/02/slug-calculation-in-barrels-for-length.html (Year: 2017).*
(Continued)

*Primary Examiner* — Caroline N Butcher
(74) *Attorney, Agent, or Firm* — Locklar PLLC

(57) ABSTRACT

A method for removing a drill string from a wellbore, the drill string comprising a plurality of pipe segments, the wellbore and the drill string defining an annulus, the annulus and the drill string containing a fluid, comprises: a) determining a desired dry pipe length; b) calculating a hydrostatic pressure for a column of fluid having a height corresponding to the desired dry pipe length; c) injecting into the drill string a gas having a pressure at least as great as the pressure calculated in step b) so as to displace fluid from an upper portion of drill string, thereby creating a dry pipe portion, wherein the length of the dry pipe portion corresponds to the desired dry pipe length; d) preventing fluid from flowing from the annulus into the drill string; and e) removing at least a part of the dry pipe portion from the wellbore.

16 Claims, 1 Drawing Sheet

(56) References Cited

U.S. PATENT DOCUMENTS

| | | | | |
|---|---|---|---|---|
| 2011/0125333 | A1* | 5/2011 | Gray | E21B 21/08 700/282 |
| 2011/0240300 | A1 | 10/2011 | Cenac | |
| 2015/0152700 | A1 | 6/2015 | Lovorn et al. | |
| 2016/0230491 | A1* | 8/2016 | Hannegan | E21B 47/07 |

OTHER PUBLICATIONS

Wild Well Control, "Causes of Kicks"; Nov. 10, 2019.
John McCaskill et al., "Managing wellbore pressure while drilling" Drilling Contractor, pp. 40-42, Mar./Apr. 2006.
"Slug Calculation in Barrels for a Length of Dry Pipe" 2017, Petrolyte: http://petrolyte.blogspot.com/2014/02/slug-calculation-in-barrels-for-length.html.
"Circulating Sub" https://www.halliburton.com/en-US/ps/testing-subsea/optimized-pressure-drilling/continuous-circulation-systems/continuous-circulation-systems.html; 2018.

* cited by examiner

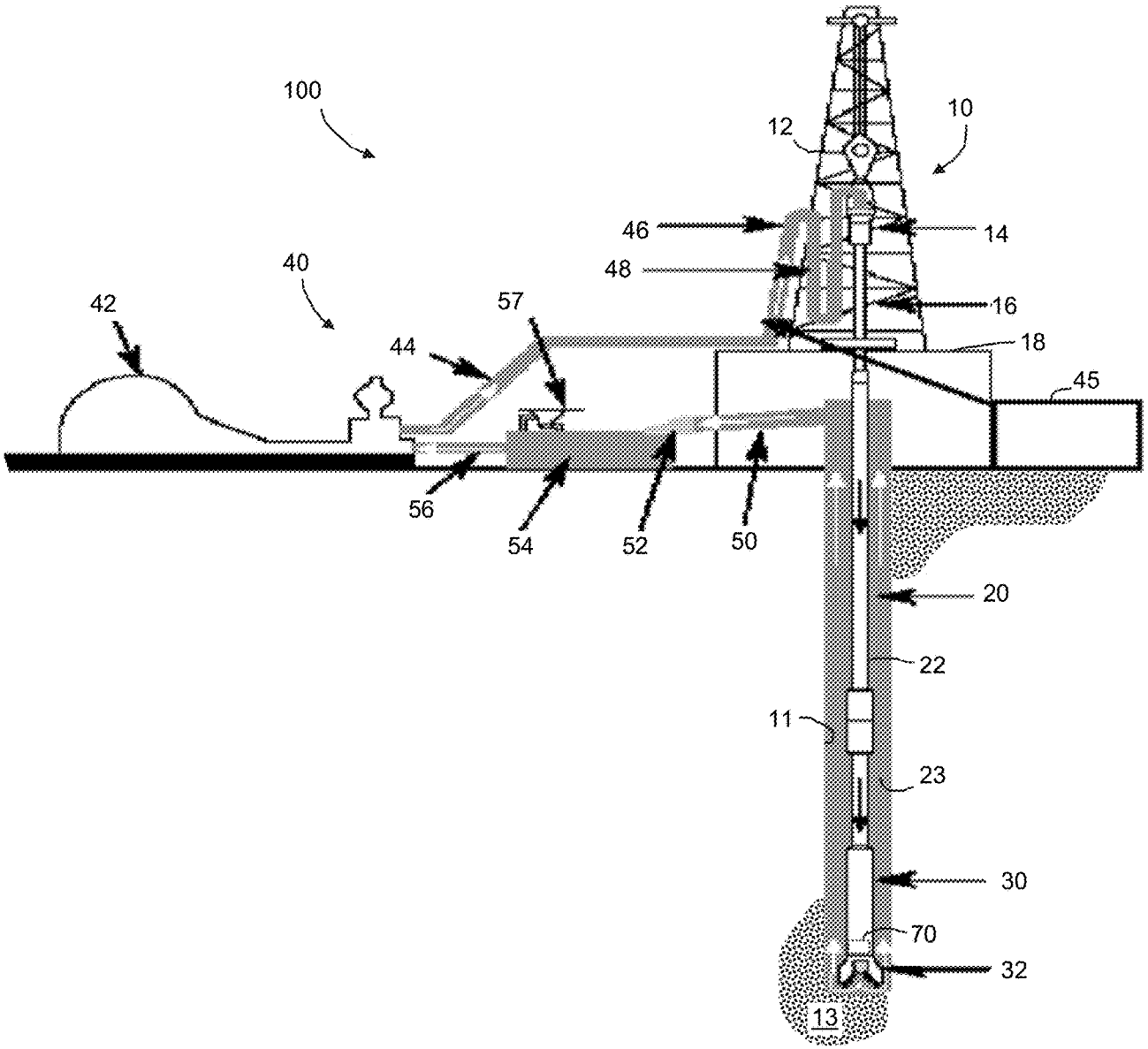
10
12
14
16
18
45
46
48
20
22
23
30
32
70
13
11
50
52
54
56
57
44
100
40
42

METHODS FOR CLEANING DRILL PIPE DURING TRIP-OUT

TECHNICAL FIELD/FIELD OF THE DISCLOSURE

The present disclosure is directed to drilling wells for hydrocarbon production.

BACKGROUND OF THE DISCLOSURE

Hydrocarbon production entails the use of drilling rigs to penetrate a subsurface formation so that hydrocarbons in the formation can flow or be pumped to the surface. Rotary drilling uses rotational motion of a bit to drill the well bore. The bit is attached to a drill string which is comprised of lengths of drill pipe. The drill bit is rotated by rotation of the drill string at the surface and/or by a mud motor downhole.

A drilling fluid, or mud, is typically circulated down through the drill string and up through the annulus between the drill string and the borehole wall or casing in order to cool the bit and remove the drill cuttings produced by operation of the bit on the bottom of the borehole. As drilling progresses, new joints of drill pipe are added. This process is commonly referred to as "tripping in."

Conversely, the drill string must also be removed periodically to replace worn bits and to remove or replace other downhole equipment such as MWD (measurement while drilling) tools, LWD (logging while drilling) tools, mud motors, or damaged drill pipe. This process is commonly referred to as "tripping out" or "pulling out of hole" (POOH). Tripping out is performed by removing two to four joints of drill pipe at a time and storing the sections, called "stands," nearby for re-use. Stands are often stored in a rack that supports the stands in a substantially vertical position.

When pipe is pulled from a fluid-filled well, fluid tends to cling to the inner and outer surfaces of the pipe. The fluid runs onto the rig floor, which may cause waste, hazard and pollution. In some operations, a wiper may be used to remove fluid from the outer pipe surface as the string moves upward through the drilling floor. The wiping apparatus may also direct the recovered fluid back to the fluid handling system. It is relatively easy to recover fluid from the outside of the pipe.

Another aspect of modern drilling relates to controlling the fluid pressure at the bottom of the borehole. It is commonly desired to prevent the flow of formation fluids into a wellbore during drilling, as inflow may lead to a loss of control of the well. Conventional overbalanced drilling (OBD) methods use a fluid system that is open to atmospheric pressure at the surface. Pumping fluid into the well creates an equivalent circulating density (ECD) that results in a bottom hole pressure (BHP) greater than pore pressure of the formation being penetrated but less than the fracture initiation pressure of the formation, thereby preventing inflow. In contrast, underbalanced drilling (UBD) uses a closed loop system to maintain an ECD that is slightly less than the pore pressure of the formation. Similarly to OBD, managed pressure drilling (MPD) entails managing surface pressure to maintain a downhole pressure slightly above BHP while keeping pressure well below the fracture initiation pressure. In MPD, the annular pressure throughout the borehole is precisely controlled and the target pressure ranges are relatively narrow. Techniques for controlling fluid pressure in a well include controlling back pressure, adjusting mud density, modifying fluid rheology, adjusting the annular fluid level, controlling circulating friction and incorporating hole geometry in the well construction.

Regardless of whether OBD, UBD, or MPD is being used and regardless of whether drilling fluid is being circulated, a pressure differential may exist between the inside of the drill string and the outside of the drillstring. The tendency of the fluid is to seek equilibrium, e.g. to flow between the casing and inside of the drill string as a result of hydrostatic pressure, is known as U-tubing. To prevent U-tubing, it is common to include at least one valve, known as a "fill valve," a "float valve," or a "non-return valve," at the bottom of the drill string.

SUMMARY

A method for removing a drill string from a wellbore, where the drill string comprises a plurality of pipe segments coupled in series, the wellbore and the drill string defining an annulus therebetween, and the annulus and the interior of the drill string are in fluid communication and contain a fluid, may comprise a) determining a desired dry pipe length; b) calculating a hydrostatic pressure for a column of fluid having a height corresponding to the dry pipe length determined in step a); c) injecting into the drill string a pressurized gas having a pressure at least as great as the pressure calculated in step b) so as to displace the fluid from an upper portion of drill string, thereby creating a dry pipe portion, wherein the length of the dry pipe portion corresponds to the dry pipe length determined in step a); d) preventing fluid from flowing from the annulus into the drill string; and e) removing at least a part of the dry pipe portion from the wellbore.

The drill string may include a float valve and step d) may include actuating the float valve. Step c) may also include calculating a displacement volume corresponding to the desired dry pipe length and injecting an amount of pressurized gas corresponding to the displacement volume. The method may also include stopping fluid circulation in the well before step c). The method may also include releasing the pressurized gas from the dry pipe portion prior to step e). Step c) may include using a sensor to determine when the length of the dry pipe portion corresponds to the dry pipe length.

The method may include connecting a pump-in-sub to the drill string. The method may further include placing a mud slug in the drill string and removing a portion of the drill string from the well before step c). A portion or all of the mud slug may be displaced from the drill string before step c) or step c) may begin before displacing a portion of the mud slug from the drill string. In some embodiments, the drill string includes a drill bit at its lower end and step c) includes displacing at least a portion of the mud slug through the drill bit.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 1 is a schematic illustration of a drilling system in accordance with some embodiments of the present disclosure.

DETAILED DESCRIPTION

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Referring initially to FIG. 1, a drilling system 100 may include a drilling rig 10, drill string 20, and mud system 40. Drilling system 100 may be used to drill a borehole 11 in a formation 13. Drilling rig 10 may include a derrick 12, swivel 14, kelly 16, and rig floor 18. Drill string 20 may comprise multiple lengths of drill pipe 22, and a bottomhole assembly (BHA) 30. BHA 30 may include one or more of: drill collars, mud motor, sensor packages, telemetry equipment (not specifically shown), and a bit 32. An annulus 23 is defined between drill string 20 and the borehole wall or casing.

Mud system 40 is adapted to retain and process drilling fluid (mud) before it is pumped into a well and after it comes out of the well. In some embodiments for example, mud system 40 may include a mud pump 42, discharge line 44, high pressure pump 45, standpipe 46, kelly hose 48, flow line 50, one or more shakers 52, one or more mud pits 54, and suction line 56. The elements of mud system 40 are fluidly connected so as to form a fluid loop through which fluid can be circulated into and out of the well. An optional mixing hopper 57 may also be included in fluid communication with mud pits 54.

During drilling operations, mud may be pumped by mud pump 42 at high pressure through discharge line 44, standpipe 46, and kelly hose 48 into the top of drill string 20. The mud flows down through drill string 20, through BHA 30 and bit 32, and returns to the surface via annulus 23. Mud returning to the surface may flow through flow line 50 may pass across one or more shakers 52, which may remove cuttings from the fluid, and enter one or more mud pits 54. If it is desired to adjust the composition of the mud, additives may be added via mixing hopper 57. Suction line 56 may be used to draw mud from mud pits 54 into mud pump 42. In other operations, such as cementing or hydraulic fracturing, other fluids may be pumped down the drill string and may or may not return to the surface via annulus 23.

When it becomes necessary or desirable to trip out of the well in order to, for example, replace the drill bit, circulation of drilling mud may be ceased. Once the mud pump is shut down, circulating pressure drops and pressure at the bottom of the wellbore also drops. In addition, removing lengths of pipe from the hole results in a reduction of fluid displaced by the pipe. Unless addressed, the reduction in displaced fluid may cause a further reduction in pressure at the bottom of the hole due to loss of mud depth. Because of the need to control pressure in the well, the hydrostatic pressure required at the bottom of the hole is calculated and the requisite mud weight and mud volume are determined before tripping begins. Thus, fluid in the hole is used to maintain bottomhole pressure during tripping.

As mentioned, above, a wiper may be used to remove fluid that clings to the outside of the drill pipe as it is removed from the hole. In instances where it is desired to pull pipe that is also substantially free of drilling fluids on its inner surface, also known as pulling "dry pipe," a slug of denser mud may first be pumped into the drill string. Because the slug is more dense than the fluid in drill string and the annulus, the volume of displaced fluid will be greater than the slug volume. As a result, if the pressures in the drill string and the annulus are allowed to equilibrate, the top of the fluid inside drill string 20 will be lower than the top of the fluid in the annulus 23. Thus, a slug may be used to displace mud out of the upper part of the drill string before pulling pipe out of the hole. If the difference in volumes is at least as great as the incremental pipe length being removed, fluid will drain from each upper pipe section, allowing the pipe sections removed from the well to be essentially "dry."

The slug may suffice to maintain the dry pipe until the BHA approaches the bottom of the slug. As the drill pipe is tripped out of the hole, the slug will approach the BHA. At some point, the slug will begin to pass through the BHA and will loses the ability to maintain a pressure differential. The internal restriction of the mud motor & MWD can also make conventional slugs less efficient.

According to some embodiments, the fluid level in the drilling fluid in drill string 20 may be lowered to a point below a pipe joint before that joint is uncoupled. The fluid level in drill string 20 may be lowered by using high pressure pump 45 to inject a pressurized gas into the top of drill string 20 so that the gas displaces the fluid to at least a level below the next joint to be uncoupled. The pressurized gas may be pumped into the top of the drill string, above the level of fluid therein. In some embodiments, the pressurized gas may be injected into, for example, standpipe 46, and enters the top of drill string 20, pushing the fluid in the drill string downward. If the volume and pressure of gas are sufficient to displace fluid from at least one length or stand of drill pipe, that length or stand of pipe can be removed "dry," i.e. without bringing a significant fluid out of the hole on the inside of the pipe. During injection, fluid is displaced out the bottom of the drill string. One or more float valves 70 (shown in phantom in FIG. 1) may be included at the bottom of drill string 20 and configured to allow fluid to flow out of drill sting 20 into annulus 23 while preventing fluid in annulus 23 from flowing into the bottom of drill string 20.

In some embodiments, once the desired amount of pressurized gas has been injected, the pressure in the drill string may be bled off. In these embodiments, the flow of pressurized gas into the top of drill string 20 may be stopped when the fluid level in drill string 20 reaches the desired location, as float valve 70 will prevent U-tubing. In some embodiments, air may be used as the pressurized gas. In other instances, it may be desirable to use natural gas or nitrogen instead of air. In some embodiments, a predetermined volume of gas at a predetermined pressure may be injected. The injected volume may be determined using a known capacity rating for the injection pump. In some embodiments, a sensor (not shown) may be used to determine when the drilling fluid has been displaced to the desired level.

EXAMPLE 1

Mud Slug

A slug comprising heavy mud (e.g., 3.0 ppg over current mud weight) may be used to push lighter mud weight down before pulling drill pipe out of hole. The average stand length is 95 ft. If it is desired to displace three pipe lengths (285 ft) of fluid from the inside of the drill string so as to allow three strands to be removed, the height of the slug needed to achieve the desired displacement can be calculated as follows. For a mud weight (MW) of 12.0 ppg, the height of the mud slug required can be calculated as follows.

1. Calculate the hydrostatic pressure required to displace the desired fluid height.

$$HP \text{ psi} = \text{Mud Weight ppg} \times 0.052 \times \text{desired length of dry pipe ft}$$

$$12 \text{ ppg} \times 0.052 \times 285 \text{ ft} = 177.8 \text{ psi}$$

2. Calculate the difference in pressure gradient between the slug weight and mud weight.

$$\Delta PG \text{ psi-ft} = (\text{slug weight ppg} - \text{mud weight ppg}) \times 0.052$$

$$(15 \text{ ppg} - 12 \text{ ppg}) \times 0.052 = 0.156 \text{ psi-ft}$$

3. Calculate length of the slug in the drill pipe.

$$\text{Slug Length ft} = HP \text{ psi} / \Delta PG \text{ psi-ft}$$

$$177.8 \text{ psi} / 0.156 \text{ psi-ft} = 1140 \text{ ft}$$

Thus, in this Example, a mud slug height of at least 1140 ft would achieve the desired displacement.

Depending on various factors, the slug height needed in a standard dry pipe trip-out might be as much as 2000 feet.

Because a mud slug will become ineffective for the bottom portion of the drill string that it occupies, it may be desired to have an alternative method for displacing fluid from the last ~2000 feet of the drill string.

EXAMPLE 2

Air Slug

If it is desired to displace the fluid in the drill string by 1900 feet (20 strands), one or more floats may be run in the drill string very close to the bit. If weight of the fluid in the annulus is 12.0 ppg, the hydrostatic pressure required to displace the desired fluid height will be:

$$12 \text{ ppg} \times 0.052 \times 1900 \text{ ft} = 1186 \text{ psi.}$$

Thus, if pressurized gas at 1186 psi is pumped into the drill string, the gas pressure will push the fluid in the drill string down 1900 feet. The pressure in the drill string can then be released, as the floats prevent the fluid from U-tubing back into the drill string. The next 20 stands of drill pipe can then be pulled dry. In some instances, it may be necessary to pull the final one or more stands wet, as it may not be desirable to displace the fluid from the entire drill string using an air slug. Thus, in some embodiments an air slug may be pumped through a downhole motor (mud motor) and, in still further embodiments, fluid in the drill string may be displaced all the way through the drill bit, so that a portion of the injected gas exits the bottom of the drill string. In such embodiments, pressure in the annulus should be monitored and controlled, as a flow of gas into the annulus may affect bottomhole pressure. Thus, pressurized gas can be used to push the remaining fluid out through the bit, resulting in a pipe dry tripping operation. In some embodiments, the pump-in sub or circulating head may be made up to the drill string directly. Compressed air can be injected through the standpipe with the top drive or kelly made up to the drill string or can be directly connected to an optional pump-in sub. If present, the pump-in sub may be removed after the compressed air is injected.

UBD and MPD operations may be good candidates for use of an air slug. During an underbalanced trip out of hole back pressure on the annulus can make it more difficult to use a mud slug. In MPD operations, where the objective to avoid gaining or losing fluid, a mud slug could weight up the mud system and could cause losses. Thus, an air slug can advantageously replace conventional mud slugs on UBD and MPD operations.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure. Further, in the claims that follow, unless explicitly so recited, the sequential recitation of steps is not intended to require that the steps be performed sequentially.

What is claimed is:

1. A method for removing a drill string from a wellbore, the drill string comprising a plurality of pipe segments coupled in series, the wellbore and the drill string defining an annulus therebetween, and the annulus and the interior of the drill string being in fluid communication and containing a fluid, the method comprising:

a) determining a desired dry pipe length;

b) calculating a hydrostatic pressure for a column of fluid having a height corresponding to the dry pipe length determined in step a);

c) placing a mud slug in the drill string and removing a portion of the drill string from the well, the mud slug comprising drilling fluid having a mud weight higher than the mud weight of the fluid;

d) injecting into the drill string a pressurized gas having a pressure at least as great as the pressure calculated in step b) so as to displace the fluid from an upper portion of drill string, thereby creating a dry pipe portion, wherein the length of the dry pipe portion corresponds to the dry pipe length determined in step a);

e) preventing fluid from flowing from the annulus into the drill string; and f) removing at least a part of the dry pipe portion from the wellbore.

2. The method according to claim 1 wherein the drill string includes a float valve and wherein step e) includes actuating the float valve.

3. The method according to claim 1 wherein step d) includes calculating a displacement volume corresponding to the desired dry pipe length and injecting an amount of pressurized gas corresponding to the displacement volume.

4. The method according to claim 1, further including stopping fluid circulation in the well before step d).

5. The method according to claim 1, further including releasing the pressurized gas from the dry pipe portion prior to step e).

6. The method according to claim 1 wherein step d) includes using a sensor to determine when the length of the dry pipe portion corresponds to the dry pipe length.

7. The method according to claim 1, further including displacing a portion of the mud slug from the drill string before beginning step d).

8. The method according to claim 1, further including beginning step d) before displacing a portion of the mud slug from the drill string.

9. The method according to claim 1 wherein the drill string includes a drill bit at its lower end and step d) includes displacing at least a portion of the mud slug through the drill bit.

10. A method for removing a drill string from a wellbore, the drill string comprising a plurality of pipe segments coupled in series, the wellbore and the drill string defining an annulus therebetween, and the annulus and the interior of the drill string being in fluid communication and containing a fluid, the method comprising:

a) determining a desired dry pipe length;

b) calculating a hydrostatic pressure for a column of fluid having a height corresponding to the dry pipe length determined in step a);

c) placing a mud slug in the drill string and removing a portion of the drill string from the well, the mud slug comprising drilling fluid having a mud weight higher than the mud weight of the fluid;

d) injecting into the drill string a pressurized gas having a pressure at least as great as the pressure calculated in step b) so as to displace the fluid from an upper portion of drill string, thereby creating a dry pipe portion, wherein the length of the dry pipe portion corresponds to the dry pipe length determined in step a);

e) releasing the pressurized gas from the dry pipe portion;

f) providing a float valve as part of the drill string and float valve and actuating the float valve so as to prevent fluid from flowing from the annulus into the drill string; and g) removing at least a part of the dry pipe portion from the wellbore.

11. The method according to claim 10 wherein step d) includes calculating a displacement volume corresponding to the desired dry pipe length and injecting an amount of pressurized gas corresponding to the displacement volume.

12. The method according to claim 11, further including stopping fluid circulation in the well before step d).

13. The method according to claim 12 wherein step d) includes using a sensor to determine when the length of the dry pipe portion corresponds to the dry pipe length.

14. The method according to claim 10, further displacing a portion of the mud slug from the drill string before step d).

15. The method according to claim 10, further including beginning step d) before displacing a portion of the mud slug from the drill string.

16. The method according to claim 10 wherein the drill string includes a drill bit at its lower end and step d) includes displacing at least a portion of the mud slug through the drill bit.

* * * * *